United States Patent [19]

Slater et al.

[11] 4,166,802

[45] Sep. 4, 1979

[54] GASIFICATION OF LOW QUALITY SOLID FUELS

[75] Inventors: William L. Slater, La Habra; George N. Richter, San Marino, both of Calif.

[73] Assignee: Texaco Inc., White Plains, N.Y.

[21] Appl. No.: 897,981

[22] Filed: Apr. 20, 1978

[51] Int. Cl.[2] ..... C01B 2/00; C10J 3/00

[52] U.S. Cl. ..... 252/373; 48/202; 48/206; 48/DIG. 7

[58] Field of Search ..... 252/373; 48/202, 206, 48/DIG. 7

[56] References Cited

U.S. PATENT DOCUMENTS

| | | | |
|---|---|---|---|
| 2,961,310 | 11/1960 | Steever | 48/206 |
| 2,987,387 | 6/1961 | Carkeek et al. | 48/206 |
| 3,528,930 | 9/1970 | Schlinger | 252/373 |
| 3,544,291 | 12/1970 | Schlinger et al. | 48/206 |
| 3,607,156 | 9/1971 | Schlinger et al. | 48/206 |
| 3,607,157 | 9/1971 | Schlinger et al. | 48/208 |
| 3,764,547 | 10/1973 | Schlinger et al. | 252/373 X |
| 3,929,429 | 12/1975 | Crouch | 48/202 |

*Primary Examiner*—Howard T. Mars

*Attorney, Agent, or Firm*—Thomas H. Whaley; Carl G. Ries; Robert Knox, Jr.

[57] ABSTRACT

Low quality solid fuels are gasified by being fed to a gasifier in a concentrated water slurry, the high solids content of the slurry being possible by subjecting the solid fuel to hydrothermal treatment in the product gas quench zone.

9 Claims, No Drawings

GASIFICATION OF LOW QUALITY SOLID FUELS

This invention is concerned with the gasification of solid carbonaceous fuel. More particularly, it is concerned with the gasification of low grade solid carbonaceous fuels which are introduced into the gasification zone in the form of a slurry in water.

One phase of our invention is concerned with the production of a slurry of solid fuel in water which slurry is suitable for feed to a generator for the gasification of the solid fuel by partial oxidation. One problem presented in such a gasification procedure is that the rate of feed of the solid fuel should be constant. When the solid fuel is suspended in a gas such as steam or oxygen, it is difficult to feed the fuel at a constant rate in that on occasion a slug of fuel may enter the gasifier resulting in a surplus of fuel. This means that some fuel will pass through the gasifier unconverted. At other times there may be a temporary fuel deficiency resulting in a surplus of oxygen with the resulting conversion of a portion of the solid fuel to $CO_2$ rather than the desired CO. One satisfactory commercial method of controlling the rate and composition of the feed is to introduce the feed into the gasifier as a slurry in water. However, because of the short residence time of the solid fuel in the gasifier it must necessarily be finely ground so that in such a short space of time it may be substantially completely gasified. Frequently, a slurry of low grade solid fuel, e.g. sub-bituminous coal or lignite, to be pumpable, contains from about 35 to 50% solids with a water content in excess of 50%. Although such a slurry is pumpable, it is unsatisfactory as the excessive amount of water has a detrimental effect on the thermal efficiency of the furnace. It is therefore important for the satisfactory operation of the gasifier that a water-solid fuel slurry used as feed have a high solids content and yet be pumpable.

The situation is aggravated when the solid carbonaceous fuel is of low quality such as sub-bituminous coal, lignite or peat. All of these fuels contain a considerable amount of combined or bound water, a most undesirable ingredient so far as gasification of the fuel is concerned in that although bound water is present in the solid fuel it does not play any part in the formation of the slurry vehicle and consequently has no effect on the viscosity or pumpability of the slurry. Actually it has an adverse effect on the gasification reaction as it introduces more water into the gasifier than is necessary to form the slurry and thus has an undesirable effect on the thermal efficiency of the generator. It is therefore desirable to remove as much combined or bound moisture as conveniently practical from the solid fuel prior to its introduction into the gas generation zone.

Accordingly, it is an object of this invention to convert solid carbonaceous fuels into useful gases comprising CO and hydrogen which may be used for fuels or for the synthesis of organic compounds or for the production of hydrogen or ammonia. Another object is to form pumpable water slurries of solid carbonaceous fuels having a solids content on a dry basis of at least 50 weight %. Still another object is to reduce the combined water content of low quality solid carbonaceous fuels prior to the gasification of such fuels. These and other objects will be obvious to those skilled in the art from the following disclosure.

According to our invention, there is provided a process for the gasification of solid carbonaceous fuels which comprises forming a slurry of said fuel in water, contacting said slurry in a quench zone with hot synthesis gas comprising carbon monoxide and hydrogen, thereby cooling said gas and heating said slurry to a temperature between about 400° and 700° F., the pressure in said quench zone being sufficiently high to keep the water in the liquid phase, removing the treated solid fuel from the quench zone and subjecting it as a water slurry containing between about 50 and 75 weight percent solids measured on a dry basis to partial oxidation to produce synthesis gas comprising carbon monoxide and hydrogen and introducing the product synthesis gas into the quench zone to cool the synthesis gas and heat the slurry.

The feed used in the process of our invention includes any solid carbonaceous combustible material containing combined or bound water in an amount such that it is difficult to form a pumpable slurry having a solids content greater than about 50 weight %. Such materials include low quality solid fuels such as sub-bituminous coal, lignite and peat. For satisfactory use in the subsequent partial oxidation zone, the particles of feed material should have no cross-sectional dimension greater than ¼ inch. Preferably at least 100 weight % of the solid fuel will pass through a 14 mesh sieve and still more preferably at least 100% through 14 with not more than 30% through a 325 mesh sieve (US standard).

The solid fuel in finely-divided form is introduced into a quench zone with water. The solid fuel and the water may be introduced separately into the quench zone or more preferably they are introduced into the quench zone in the form of a slurry. Because of the nature of the solid fuel, it is difficult to form a pumpable slurry having a solids content in excess of 50 weight % so that the solid fuel and water are generally introduced into the quench zone as a slurry containing less than 50 weight % solids, usually 25–40%.

In the quench zone, the slurry is contacted with hot synthesis gas comprising carbon monoxide and hydrogen which has been prepared by the partial oxidation of a solid carbonaceous fuel preferably the same type of fuel used in making the slurry present in the quench zone. The hot synthesis gas which leaves the partial oxidation zone at a temperature between about 1800° and 3200° F. is introduced substantially immediately into the quench zone and contact is made with the slurry preferably by discharging the hot synthesis gas from a dip tube under the surface of the slurry. Preferably the dip tube has a dispersing device such as a serrated lower edge to assist in the distribution of the synthesis gas throughout the slurry thereby permitting intimate contact between the gas and the slurry with efficient cooling of the synthesis gas. The quench zone is maintained at substantially the same pressure as the partial oxidation zone which should be at least sufficient to maintain liquid water in the quench zone. As the preferred temperature of the slurry is between about 400° and 600° F. the pressure in the partial oxidation and quench zones may be maintained between about 500 and 3000 psig. The residence time of the solid carbonaceous fuel in the quench zone may be between about 0.1 minute and 1 hour depending on the extent to which it is desired to release the combined or bound water. A preferred residence time ranges between about 1 and 15 minutes. In the quench zone the heavier particles of ash and slag from the partial oxidation descend to the lower portion of the quench zone and may be removed by mechanical means such as a lock hopper.

The slurry composed primarily of solid carbonaceous fuel, water, finely-divided ash particles and particles of unconverted solid carbonaceous fuel is removed from the quench zone and there is recovered from the slurry a feed slurry containing between about 50 and 75% solids by weight on a dry basis. The formation of the feed slurry may be effected by transferring the heated slurry from the quench zone to a settling zone where the slurry settles into an upper portion having a lower solid content and a lower portion having a higher solid content. Some entrained slag and ash particles will settle to the bottom of the settling zone and can be drawn off as bottoms and disposed of e.g. to a slag pit. After a sufficient period of time the lower portion of the slurry may be drawn off as a feed slurry having the desired solid content and the upper portion may be used to make fresh slurry for the quench zone.

It is also possible and results in a saving of time to pass the heated slurry into a concentrating device such as a centrifuge or hydroclone where water is removed. A slurry having the desired solid content may then be formed. It thus becomes possible after the solid fuel-water slurry has been in the quench zone at a temperature of at least 400° F. for a period of time of at least 0.1 minute and preferably at least 1 minute to form a slurry having a solids content in excess of 50 weight % whereas this is hardly possible with low quality solid fuels without the heat treatment. This hydrothermal treatment in the quench zone serves to release some of the bound or combined water from the solid carbonaceous fuel thus permitting the formation of a pumpable slurry having a solids content on a dry basis well in excess of 50 weight %. The feed slurry having the desired solids content may then be gasified in the usual manner and the hot synthesis gas brought into contact with fresh slurry in the quench zone.

The gasification of solid carbonaceous fuels is well known in the art and needs no further description here. It may be practiced according to the disclosure of, for example, U.S. Pat. No. 3,544,291 issued Dec. 1, 1970 to W. G. Schlinger and W. L. Slater, the disclosure of which is incorporated herein by reference.

The following example is given for illustrative purposes only and it should not be construed that the invention is restricted thereto.

The feed in this example is a North Dakota lignite having an ash content of 9.5 wt. %. When ground so that 100% passes through a 14 mesh sieve, the maximum solids content of a pumpable water-ground lignite slurry is 42 to 44 wt. % measured on a dry basis. For start-up purposes, the generator is fired with a 43% slurry of the lignite to heat the generator to a temperature of at least about 2000° F. and the slurry is also introduced into a quench chamber situated below the generator gasification chamber.

The pressure is adjusted to about 1300 psig and the combustion products are introduced under the surface of the slurry in the quench chamber. The temperature of the slurry in the quench chamber is held at 500° F. for about seven minutes by circulating it through a cooler and recycling it back to the quench chamber. The larger portions of ash leaving the gas generation chamber are more dense and settle to the bottom of the quench chamber from whence they are removed periodically through a lock hopper. The introduction of the combustion products below the surface of the slurry in the quench chamber causes sufficient agitation to keep the smaller particles of ash and unconverted carbon and soot in suspension in the slurry.

After the slurry has been held at a temperature of about 500° F. under a pressure of 1300 psig for about seven minutes it is withdrawn and is replaced by fresh 42–44% lignite in water slurry added to the quench chamber. The withdrawn slurry is introduced into a settling zone having an inverted conical lower section where it separates into an upper layer of clarified water and a lower layer of concentrated slurry with any remaining relatively larger ash particles settling to the bottom from whence they are withdrawn and discharged to a slag pit. The upper layer of clarified water may be recycled for quenching purposes. The concentrated slurry layer containing from 54 to 55 wt. % solids is removed from the settling zone and introduced into the gasification zone together with oxygen for the partial combustion of the carbon content of lignite and the resultant production of synthesis gas. The hot synthesis gas leaving the partial combustion zone is introduced into the slurry in the quench zone which is maintained at substantially the same pressure as the partial combustion zone, specifically in this case about 1300 psig and a temperature of about 500° F.

Cooled synthesis gas composed primarily of hydrogen and carbon monoxide leaves the quench zone and is suitable for use as a fuel or may be used for the production of organic compounds.

After steady state operation has been reached, a feed stream containing 1050 lbs. of fresh finely-divided lignite, of which 100 lbs. is ash, is introduced into the quench chamber with 1450 lbs. of water per hour. From the quench chamber there is withdrawn from the bottom thereof 100 pounds per hour of ash and from the upper section a side-stream containing 1050 pounds per hour of thermally-treated lignite and also containing 50 pounds of ungasified lignite and 100 pounds of ash. This side stream is sent to a settling chamber where it separates into an upper clarified water layer, and a lower concentrated slurry layer with the larger ash particles settling out. Concentrated slurry containing 1050 pounds of hydrothermally-treated lignite, 50 pounds of unconverted lignite and 100 pounds of ash, carried out of the quench zone suspended in the slurry, in 1000 pounds of water is introduced per hour into the gas generation or partial oxidation zone.

Oxygen of 95% purity is also introduced into the partial oxidation zone at a C:O atomic ratio of 1. Reaction conditions in the partial oxidation zone are a temperature of 2250° F. and a pressure of 1300 psig with a 95% conversion of the carbon in the feed to oxides of carbon.

Once a run has been terminated, the next run may be started using a concentrated slurry as feed to the gas generation zone rather than the 42% slurry used in the initial start-up as there will be some hydrothermally treated lignite available from the preceding run.

The product gas contains 35.6 percent hydrogen and 40.7 percent CO and is useful for the production of hydrogen by shift conversion or may be used as fuel per se or may be used in the synthesis of organic compounds.

By subjecting the raw lignite to hydrothermal treatment in the quench chamber where the heat is supplied by the synthesis gas, it is possible to form a pumpable slurry of the finely-divided lignite containing more than 50 wt. % solids measured on a dry basis whereby the gasifier can be operated in an efficient manner. If the hydrothermal treatment is omitted, the maximum solids content of a pumpable slurry of the finely-divided raw lignite is 42–44 wt. % solids which is unsatisfactory for effective operation of the gasifier.

As mentioned above, the slurry removed from the quench or contacting zone may be concentrated by mechanical means such as a centrifuge or hydroclone whereby the bulk of the water may be removed and the solids content may be adjusted to form a pumpable slurry with a minimum of water. Here again, the clarified water removed from the slurry may be used to make additional initial slurry or may be injected into the raw synthesis gas as it leaves the partial oxidation zone just prior to its entry into the quench or contacting zone.

While the contacting or quench zone has been described as being directly connected to the gasifier or partial oxidation zone, it is also possible to subject the solid fuel-water slurry to hydrothermal treatment in the presence of synthesis gas in a separate vessel using synthesis gas which has already been quenched and/or scrubbed. However, it is preferred to contact the initial slurry in the quench zone with raw synthesis gas as it leaves the partial oxidation or gasification zone.

Various modifications of the invention as hereinbefore set forth may be made without departing from the spirit and scope thereof, and therefore, only such limitations should be made as are indicated in the appended claims.

We claim:

1. A process for the gasification of a solid carbonaceous fuel selected from the group consisting of subbituminous coal and lignite which comprises forming an initial slurry of said fuel in water, containing less than 50 weight percent solids, contacting said initial slurry with hot synthesis gas comprising carbon monoxide and hydrogen in a quench zone thereby cooling said gas and heating said initial slurry to a temperature between about 400° F. and 700° F., the pressure in said quench zone being sufficiently high to keep the water in liquid phase, maintaining the slurry under said conditions of temperature and pressure for a period of time between 0.1 minute and 1 hour, subjecting the so treated fuel as a concentrated water slurry containing between about 50 and 75 wt. % solids measured on a dry basis to partial oxidation to produce additional synthesis gas comprising carbon monoxide and hydrogen and introducing said additional synthesis gas into said quench zone to heat additional initial slurry and quench said additional synthesis gas.

2. The process of claim 1 in which the treated slurry is removed from the quench zone and is sent to a settling zone.

3. The process of claim 2 in which in the settling zone the slurry is separated into a clarified water layer and a concentrated slurry layer.

4. The process of claim 3 in which the clarified water is used to make additional initial slurry.

5. The process of claim 3 in which the clarified water is used to cool hot synthesis gas prior to its contact with said initial slurry in said quench zone.

6. The process of claim 1 in which the pressure in the partial oxidation zone and the quench zone is between about 500 psig and 3000 psig.

7. The process of claim 1 in which the temperature in the quench zone is between about 400° F. and 600° F.

8. The process of claim 1 in which the period of time is between about 1 minute and 15 minutes.

9. The process of claim 1 in which the slurry removed from the quench zone is concentrated by mechanical means.

* * * * *